US007561041B2

(12) United States Patent
Nguyen et al.

(10) Patent No.: US 7,561,041 B2
(45) Date of Patent: Jul. 14, 2009

(54) MONITORING AND ENTRY SYSTEM PRESENCE SERVICE

(75) Inventors: Hong Thi Nguyen, Atlanta, GA (US); Michael Sean Denny, Sharpsburg, GA (US)

(73) Assignee: AT&T Intellectual Property I, L.P., Reno, NV (US)

( * ) Notice: Subject to any disclaimer, the term of this patent is extended or adjusted under 35 U.S.C. 154(b) by 339 days.

(21) Appl. No.: 11/520,262

(22) Filed: Sep. 13, 2006

(65) Prior Publication Data

US 2008/0068150 A1 Mar. 20, 2008

(51) Int. Cl.
*G08B 21/00* (2006.01)

(52) U.S. Cl. ..... 340/540; 340/541; 340/565

(58) Field of Classification Search ..... 340/540, 340/501, 541, 825.49, 7.46, 7.56, 573.1, 340/539.1, 468, 550, 551, 565; 379/167.05; 709/229

See application file for complete search history.

(56) References Cited

U.S. PATENT DOCUMENTS

| | | | | |
|---|---|---|---|---|
| 5,675,733 | A | 10/1997 | Williams | |
| 5,720,771 | A | 2/1998 | Snell | |
| 5,793,365 | A | 8/1998 | Tang | |
| 5,796,393 | A | 8/1998 | MacNaughton | |
| 5,812,639 | A | 9/1998 | Bartholomew | |
| 5,926,179 | A | 7/1999 | Matsuda | |
| 6,047,327 | A | 4/2000 | Tso | |
| 6,058,420 | A | 5/2000 | Davies | |
| 6,108,709 | A | 8/2000 | Shinomura | |
| 6,151,507 | A | 11/2000 | Laiho | |
| 6,286,033 | B1 | 9/2001 | Kishinsky | |
| 6,301,609 | B1 | 10/2001 | Aravamudon | |
| 6,425,006 | B1 | 7/2002 | Chari | |
| 6,429,893 | B1 * | 8/2002 | Xin | 348/155 |
| 6,466,261 | B1 * | 10/2002 | Nakamura | 348/151 |
| 6,546,005 | B1 | 4/2003 | Berkley | |
| 6,553,416 | B1 | 4/2003 | Chari | |
| 6,584,494 | B1 | 6/2003 | Manabe | |
| 6,591,094 | B1 | 7/2003 | Bentley | |
| 6,654,790 | B2 | 11/2003 | Ogle | |

(Continued)

FOREIGN PATENT DOCUMENTS

WO PCT/US03/14671 5/2003

(Continued)

OTHER PUBLICATIONS

Holt; U.S. Appl. No. 10/144,425, filed May 13, 2002.

(Continued)

*Primary Examiner*—Toan N Pham
(74) *Attorney, Agent, or Firm*—Thomas, Kayden, Horstemeyer & Risley, LLP

(57) ABSTRACT

A monitoring and entry system presence service provides notification about a trigger event to a user and performs actions based on user input. Interface devices equipped with client applications capable of performing actions such as VoIP calls, video calls, and the like, register with a control and session layer, which facilitates interaction with a specific presence application and an integrated presence service, such as a doorbell application and a generic presence service. Upon determining the location of a user, notification and a list of actions are provided through a watcher client application. In response to the user selection, actions are facilitated through the same network session(s).

18 Claims, 9 Drawing Sheets

MONITORING AND ENTRY SYSTEM PRESENCE SERVICE ARCHITECTURE

U.S. PATENT DOCUMENTS 6,658,095 B1 12/2003 Yoakum
6,665,375 B1 12/2003 Forlenza
6,668,169 B2 12/2003 Burgan
6,727,811 B1 4/2004 Fendis
6,731,308 B1 5/2004 Tang
6,757,365 B1 6/2004 Bogard
6,757,722 B2 6/2004 Lonnfors et al.
6,771,173 B1 * 8/2004 Clayton et al. ..... 340/573.1
6,816,578 B1 11/2004 Kredo
6,879,677 B2 4/2005 Trandal
6,944,555 B2 9/2005 Blackett
6,954,136 B2 10/2005 Sauer
6,965,935 B2 11/2005 Diong
6,987,840 B1 1/2006 Bosik
6,993,327 B2 1/2006 Mathis
7,015,806 B2 * 3/2006 Naidoo et al. ..... 340/531
7,020,696 B1 3/2006 Perry et al.
7,043,530 B2 5/2006 Isaacs
7,058,036 B1 6/2006 Yu
7,262,690 B2 * 8/2007 Heaton et al. ..... 340/500
7,302,270 B1 11/2007 Day
7,313,617 B2 12/2007 Malik
7,321,921 B2 1/2008 Malik
7,324,826 B2 1/2008 Carey
7,353,455 B2 4/2008 Malik
7,370,278 B2 5/2008 Malik
7,395,329 B1 7/2008 Holt
2002/0026483 A1 2/2002 Isaacs
2002/0032740 A1 3/2002 Stern
2002/0035605 A1 3/2002 McDowell
2002/0046299 A1 4/2002 Lefeber
2002/0160757 A1 10/2002 Shavit
2003/0018903 A1 1/2003 Greca
2004/0003046 A1 1/2004 Grabelsky
2004/0044738 A1 3/2004 Ohno et al.
2004/0085205 A1 * 5/2004 Yeh ..... 340/540
2004/0086093 A1 * 5/2004 Schranz ..... 379/37
2004/0153506 A1 8/2004 Ito et al.
2004/0171396 A1 9/2004 Carey
2004/0177118 A1 9/2004 Mason
2004/0267887 A1 12/2004 Berger
2005/0010644 A1 1/2005 Brown
2005/0166154 A1 7/2005 Wilson
2005/0216565 A1 9/2005 Ito et al.
2005/0228895 A1 10/2005 Karunamurthy et al.
2006/0004924 A1 1/2006 Trossen
2006/0167998 A1 7/2006 Yoshiuchi et al.
2006/0242239 A1 10/2006 Morishima et al.
2006/0253593 A1 11/2006 Jachner
2007/0136475 A1 6/2007 Keppisaari et al.
2007/0182541 A1 8/2007 Harris et al.
2008/0184136 A1 7/2008 Malik
2008/0209347 A1 8/2008 Malik
2008/0244026 A1 10/2008 Holt

FOREIGN PATENT DOCUMENTS

WO PCT/US03/15814 5/2003
WO 03/098449 11/2003
WO 03/100637 12/2003

OTHER PUBLICATIONS

Holt; U.S. Appl. No. 12/133,590, filed Jun. 5, 2008.
Malik; U.S. Appl. No. 10/223,859, filed Aug. 19, 2002.
Malik; U.S. Appl. No. 12/059,320, filed Mar. 31, 2008.
Malik; U.S. Appl. No. 10/985,361, filed Nov. 10, 2004.
Malik; U.S. Appl. No. 12/115,004, filed May 5, 2008.
Adamczyk; U.S. Appl. No. 10/745,199, filed Dec. 23, 2003.
Malik; U.S. Appl. No. 10/889,859, filed Jul. 13, 2004.
Malik; U.S. Appl. No. 12/017,999, filed Jan. 22, 2008.
Nguyen; U.S. Appl. No. 11/520,262, filed Sep. 13, 2006.
Daigle; U.S. Appl. No. 11/304,319, filed Dec. 15, 2005.
Holt; Final Rejection mailed Feb. 27, 2006 for U.S. Appl. No. 10/144,425, filed May 13, 2002.
Holt; Final Rejection mailed Jun. 19, 2007 for U.S. Appl. No. 10/144,425, filed May 13, 2002.
Holt; Non-Final Rejection mailed Jan. 3, 2007 for U.S. Appl. No. 10/144,425, filed May 13, 2002.
Holt; Non-Final Rejection mailed Jul. 14, 2006 for U.S. Appl. No. 10/144,425, filed May 13, 2002.
Holt; Non-Final Rejection mailed Aug. 25, 2005 for U.S. Appl. No. 10/144,425, filed May 13, 2002.
Holt; Notice of allowance and Fees Due mailed Jan. 28, 2008 for U.S. Appl. No. 10/144,425, filed May 13, 2002.
Malik; Advisory Action mailed Jun. 11, 2004 for U.S. Appl. No. 10/223,859, filed Aug. 19, 2002.
Malik; Examiner Interview Summary mailed Apr. 21, 2004 for U.S. Appl. No. 10/223,859, filed Aug. 19, 2002.
Malik; Examiner Interview Summary mailed Nov. 14, 2003 for U.S. Appl. No. 10/223,859, filed Aug. 19, 2002.
Malik; Final Rejection mailed Feb. 24, 2004 for U.S. Appl. No. 10/223,859, filed Aug. 19, 2002.
Malik; Final Rejection mailed Sep. 7, 2006 for U.S. Appl. No. 10/223,859, filed Aug. 19, 2002.
Malik; Final Rejection mailed Nov. 21, 2005 for U.S. Appl. No. 10/223,859, filed Aug. 19, 2002.
Malik; Non-Final Rejection mailed Mar. 13, 2006 for U.S. Appl. No. 10/223,859, filed Aug. 19, 2002.
Malik; Non-Final Rejection mailed May 18, 2005 for U.S. Appl. No. 10/223,859, filed Aug. 19, 2002.
Malik; Non-Final Rejection mailed Jun. 6, 2007 for U.S. Appl. No. 10/223,859, filed Aug. 19, 2002.
Malik; Non-Final Rejection mailed Sep. 2, 2003 for U.S. Appl. No. 10/223,859, filed Aug. 19, 2002.
Malik; Non-Final Rejection mailed Oct. 20, 2004 for U.S. Appl. No. 10/223,859, filed Aug. 19, 2002.
Malik; Notice of Allowance and Fees Due mailed Dec. 5, 2007 for U.S. Appl. No. 10/223,859, filed Aug. 19, 2002.
Malik; Pre-Brief Appeal Conference Decision mailed Mar. 15, 2007 for U.S. Appl. No. 10/223,859, filed Aug. 19, 2002.
Mailk; Final Rejection mailed Dec. 5, 2006 for U.S. Appl. No. 10/985,361, filed Nov. 10, 2004.
Malik; Advisory Action mailed Feb. 28, 2007 for U.S. Appl. No. 10/985,361, filed Nov. 10, 2004.
Malik; Non-Final Rejection mailed Jun. 5, 2006 for U.S. Appl. No. 10/985,361, filed Nov. 10, 2004.
Malik; Non-Final Rejection mailed Jun. 19, 2007 for U.S. Appl. No. 10/985,361, filed Nov. 10, 2004.
Malik; Notice of Allowance and Fees Due mailed Jan. 11, 2008 for U.S. Appl. No. 10/985,361, filed Nov. 10, 2004.
Adamczyk; Non-Final Rejection mailed Mar. 26, 2008 for U.S. Appl. No. 10/745,199, filed Dec. 23, 2003.
Malik; Examiner Interview Summary mailed Jan. 4, 2006 for U.S. Appl. No. 10/889,859, filed Jul. 13, 2004.
Malik; Examiner Interview Summary mailed Jun. 5, 2006 for U.S. Appl. No. 10/889,859, filed Jul. 13, 2004.
Malik; Examiner Interview Summary mailed Jun. 19, 2007 for U.S. Appl. No. 10/889,859, filed Jul. 13, 2004.
Malik; Examiner Interview Summary mailed Aug. 2, 2006 for U.S. Appl. No. 10/889,859, filed Jul. 13, 2004.
Malik; Examiner Interview Summary mailed Sep. 27, 2007 for U.S. Appl. No. 10/889,859, filed Jul. 13, 2004.
Malik; Final Rejection mailed Mar. 28, 2006 for U.S. Appl. No. 10/889,859, filed Jul. 13, 2004.
Malik; Final Rejection mailed Dec. 12, 2006 for U.S. Appl. No. 10/889,859, filed Jul. 13, 2004.
Malik; Non-Final Rejection mailed Apr. 9, 2007 for U.S. Appl. No. 10/889,859, filed Jul. 13, 2004.
Malik; Non-Final Rejection mailed Jun. 27, 2006 for U.S. Appl. No. 10/889,859, filed Jul. 13, 2004.
Malik; Non-Final Rejection mailed Nov. 4, 2005 for U.S. Appl. No. 10/889,859, filed Jul. 13, 2004.

Malik; Notice of Allowance and Fees Due mailed Sep. 27, 2007 for U.S. Appl. No. 10/889,859, filed Jul. 13, 2004.

Definition of "Ack", Newton's Telecom Dictionary, CMP books, 20th edition, Feb. 1, 2004, p. 42.

Malik; Non-Final Rejection mailed Oct. 1, 2008 for U.S. Appl. No. 12/017,999, filed Jan. 22, 2008.

Adamczyk; Final Rejection mailed Oct. 14, 2008 for U.S. Appl. No. 10/745,199, filed Dec. 23, 2003.

Daigle; Non-Final Rejection mailed Nov. 20, 2008 for U.S. Appl. No. 11/304,319, filed Dec. 15, 2005.

Nguyen; Non-Final Rejection mailed Mar. 9, 2009 for U.S. Appl. No. 11/524,668 filed Sep. 21, 2006 (Copy not provided as PTO generated).

Nguyen; Non-Final Rejection mailed Mar. 12, 2009 for U.S. Appl. No. 11/525,008 filed Sep. 21, 2006 (Copy not provided as PTO generated).

Adamczyk; Advisory Action mailed Dec. 31, 2008 for U.S. Appl. No. 10/745,199 filed Dec. 23, 2003 (Copy not provided as PTO generated).

* cited by examiner

MONITORING AND ENTRY SYSTEM PRESENCE SERVICE ARCHITECTURE

EXAMPLE DOORBELL PRESENCE SERVICE ARCHITECTURE

IMS ARCHITECTURE

EXAMPLE DOORBELL PRESENCE SERVICE WITH IMS ARCHITECTURE

EXAMPLE DOORBELL PRESENCE SERVICE

DOORBELL PRESENCE SERVICE FLOWS

EXAMPLE DOORBELL PRESENCE APPLICATION UI

DOORBELL PRESENCE SERVICE: EXAMPLE WATCHER ACTIONS

MONITORING AND ENTRY SYSTEM PRESENCE SERVICE

RELATED APPLICATIONS

The present application may be found to be related to U.S. Patent Application entitled: "DOORBELL PRESENCE HARDWARE", Ser. No. 11/520,131, filed with the USPTO on the same day as this patent application.

TECHNICAL FIELD

Embodiments are related to presence services. More particularly, the disclosed subject matter is related to computer-implemented methods, configurations, systems, and computer program products for facilitating integration of monitoring and entry systems with a presence service.

BACKGROUND

With the proliferation and improvement of network communications and the Internet, security monitoring applications have begun to take advantage of networking capabilities. Many applications are available today, which allow users to access their monitoring system remotely through the Internet and perform actions such as configuring the system, receiving status updates, and the like.

Intelligent devices are increasingly popular in modern society. In addition, these devices whether cell phones, computers, or motion detectors are usually connected to a network such as the Internet. In this interconnected environment, the trend is to provide presence awareness information about almost anyone to almost anyone. "Buddy List" applications, which enable people to communicate and/or forward their incoming communications to their designees, are becoming common in cellular phone and instant messaging systems. For example, some cellular phone companies provide a service, where a calling party can be forwarded to the called person at any number. All the called person has to do, is provide a list of numbers where they can be reached. The system automatically searches for the called person until he or she is found and facilitates the connection.

SUMMARY

Consistent with embodiments described herein, systems and methods are disclosed for providing a notification and interaction system integrated with a unified presence application interface. Key features or essential features of the claimed subject matter are not necessarily identified in this summary portion.

Embodiments are directed to a service and system that provides notification to a user in response to a trigger event at an interface device, such as a doorbell, an alarm monitor, and the like. The service may include an integrated unified presence system, which allows the user to be notified through one of a plurality of means. The user may be provided a selection of actions in response to the notification including, but not limited to, two-way communication, enabling entry to a premise, obtaining a video or image of a location of interest, and the like.

It is to be understood that both the foregoing general description and the following detailed description are exemplary and explanatory only, and should not be considered restrictive of the scope of the invention, as described and claimed. Further, features and/or variations may be provided in addition to those set forth herein. For example, embodiments of the invention may be directed to various combinations and sub-combinations of the features described in the detailed description.

DETAILED DESCRIPTION

Figure 1:
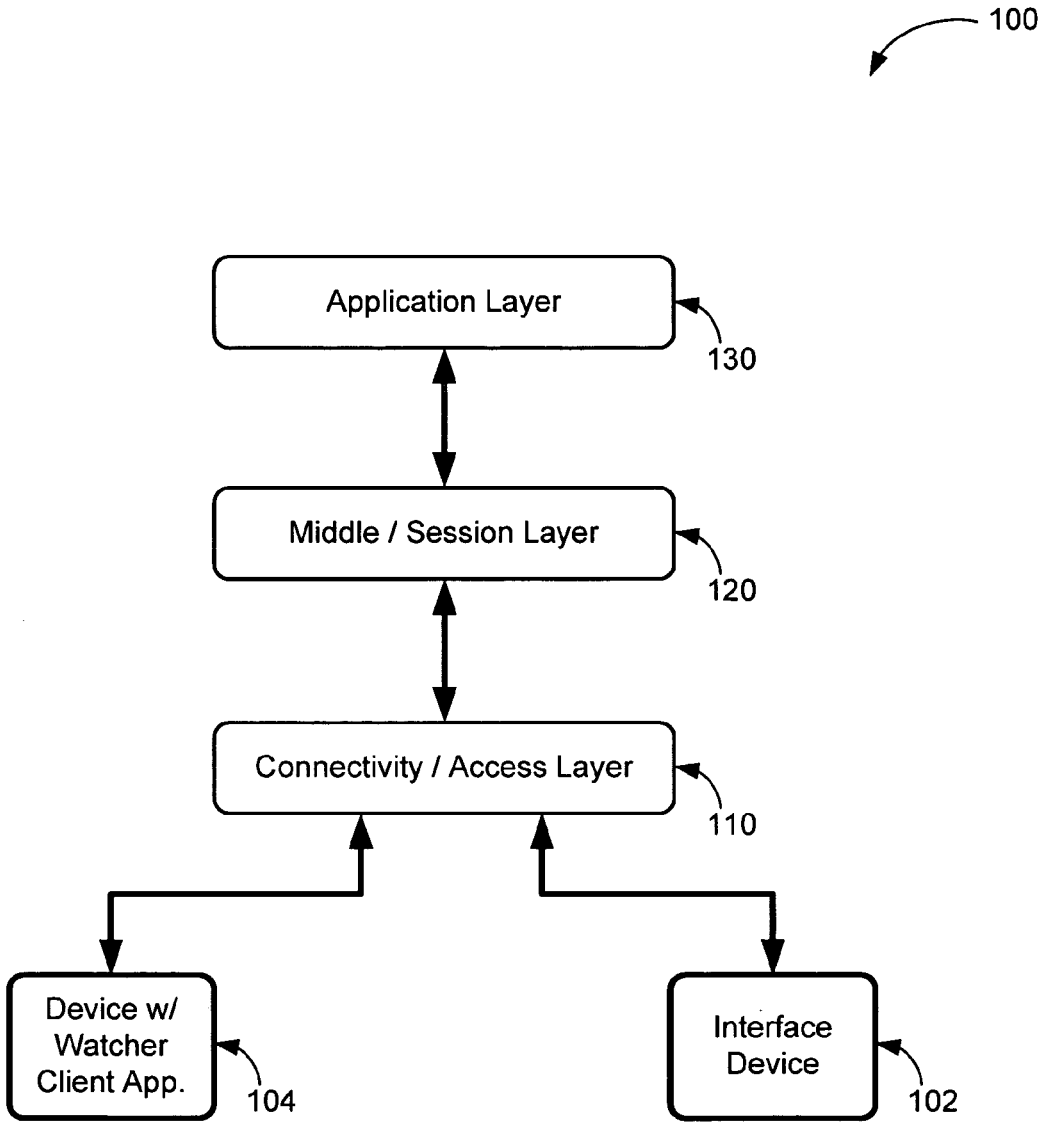
FIG. 1 is a diagram of a monitoring and entry system presence service architecture.

As briefly described above, a notification and interaction service may be provided with an integrated unified presence service. In the following detailed description, references are made to the accompanying drawings that form a part hereof, and in which are shown by way of illustrations specific embodiments or examples. These aspects may be combined, other aspects may be utilized, and structural changes may be made without departing from the spirit or scope of the present disclosure. The following detailed description is therefore not to be taken in a limiting sense, and the scope of the present invention is defined by the appended claims and their equivalents.

Referring now to the drawings, aspects, exemplary operating environments, and configurations will be described. While the embodiments will be described in the general context of program modules that execute in conjunction with an application program that runs on an operating system on a personal computer, those skilled in the art will recognize that aspects may also be implemented in combination with other program modules.

Embodiments may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process.

Generally, program modules include routines, programs, components, data structures, and other types of structures that perform particular tasks or implement particular abstract data types. Moreover, those skilled in the art will appreciate that embodiments may be practiced with other computer system configurations, including hand-held devices, multiprocessor systems, microprocessor-based or programmable consumer electronics, minicomputers, mainframe computers, and the like. Embodiments may also be practiced in distributed computing environments where tasks are performed by remote processing devices that are linked through a communications network. In a distributed computing environment, program modules may be located in both local and remote memory storage devices.

With reference to FIG. 1, a diagram of a monitoring and entry system presence service architecture is shown. Architecture 100 includes at a base level two kinds of physical devices: interface device 102 and device with watcher client application 104. Interface device is typically a component of a monitoring or entry system configured to provide the triggering event(s). For example, interface device 102 may include a doorbell integrated with additional functionality or an alarm monitor device also integrated with additional functionality. Device with watcher client application 104 is used to provide the user with notification of the trigger event, present a selection of actions, and forward the user's selection to an application for execution of tasks associated with the selected action. In other embodiments, the user may be notified through one device and select actions to be performed through another device.

Connectivity and access layer 110 includes network infrastructure that is used to provide interconnection between devices 102, 104 and applications at higher levels. Connectivity layer may include any network or combination of networks. These network(s) may include a secure network such as a home network or an enterprise network, or an unsecure network such as a wireless open network. The networks provide communication between the nodes described above. By way of example, and not limitation, the networks may include wired media such as a wired network or direct-wired connection, and wireless media such as acoustic, RF, infrared and other wireless media.

Control and session layer 120 is arranged to facilitate communication sessions between the physical devices and the applications, as well as between the applications and any network resources such as data stores. According to some embodiments, the control and session layer may be integrated with an IP Multimedia System (IMS) for providing a unified presence service.

Application layer 130 includes one or more applications associated with providing a notification and interaction service with an integrated unified presence service. Application layer 130 may include an application arranged to perform actions associated with the devices 102 and 104, an application for providing the presence service, and even an application for providing a location service to determine a location of a user to be notified.

Interface device 102 and device with watcher client application 104 may include or may be part of a computing device. Computing devices typically include a processing device and a system memory. Computing devices may also include additional processing devices, which may be dedicated processors or enable distributed processing by coordinating with a main processing device. The system memory may be volatile (such as RAM), non-volatile (such as ROM, flash memory, etc.) or some combination of the two. System memory typically provides an environment for an operating system to be executed for controlling the operation of computing device 100 and execution of other programs (applications). Watcher client application, two-way communication applications, imaging or video communication applications are examples of programs or program modules that may be executed in the system memory. These applications may be an integrated part of a single program or separate applications. They may communicate with other applications running on the computing device or on other devices.

The computing devices may have additional features or functionality. For example, the computing devices may also include data storage devices (removable and/or non-removable) such as, for example, magnetic disks, optical disks, or tape. Computer storage media may include volatile and non-volatile, removable and non-removable media implemented in any method or technology for storage of information, such as computer readable instructions, data structures, program modules, or other data. The system memory and storage devices are examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by the computing device. Any such computer storage media may be part of the computing device.

Computing devices may also include input devices such as a keyboard, a keypad, a voice input device, a touch input device, a camera etc. Furthermore, output devices such as a display, a speaker, a printer, etc. may also be included. These devices are well known in the art.

Communication connections may be included in the computing devices to allow the device to communicate with other computing devices executing above described applications, such as over a network in a distributed computing environment, for example, an intranet or the Internet. Communication connections may include media that may be embodied by computer readable instructions, data structures, program modules, or other data in a modulated data signal, such as a carrier wave or other transport mechanism, and include any information delivery media.

By way of example, and not limitation, communication media may include wired media such as a wired network or direct-wired connection, and wireless media such as acoustic, RF, infrared and other wireless media. The term computer readable media as used herein refers to both storage media and communication media. Communication media is employed to provide interconnection between interface device 102, device with watcher client application 104 and networks of connectivity and access layer 110.

The implementation of embodiments for interface device 102 and device with watcher client application 104 is not limited to the computing devices described above. Other computing devices with different components, configurations, and the like, may be used to execute computer readable instructions implementing embodiments described herein without departing from a scope and spirit of the claimed subject matter.

Figure 2:
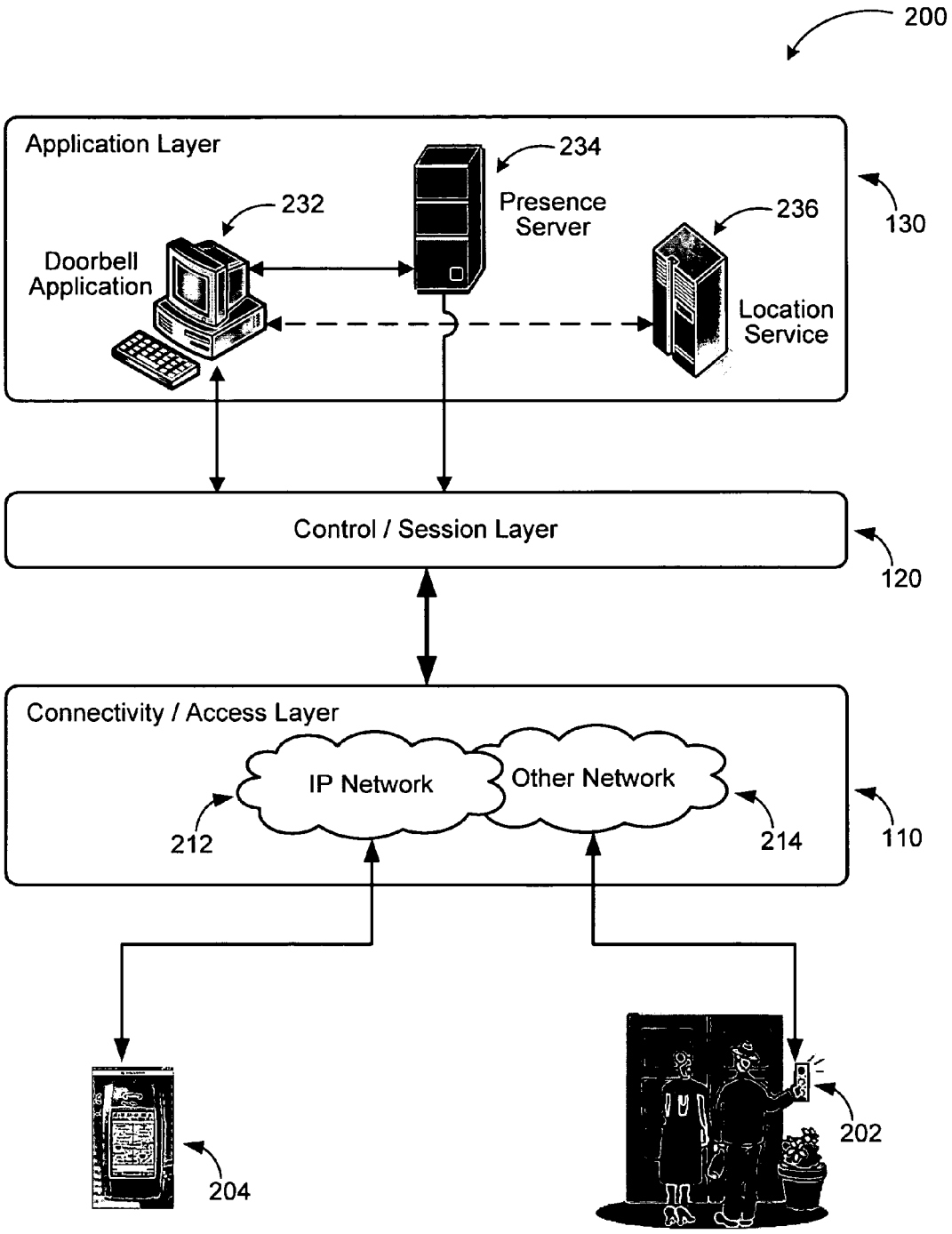
FIG. 2 illustrates an example doorbell presence service architecture where example embodiments may be implemented.

FIG. 2 and the following discussion are intended to provide a brief, general description of a suitable computing environment in which the invention may be implemented. Referring to FIG. 2, an example doorbell presence service architecture, where example embodiments may be implemented, is illustrated. Architecture 200 may include at various layers any topology of servers, clients, Internet service providers, and communication media. Applications such as doorbell application 232 and location service 236 may be one or more programs or a server machine executing programs associated with the server tasks. Client devices and servers may be embodied as single device (or program) or a number of devices (programs). Similarly, data sources may include one or more data stores, input devices, and the like.

Interface device 102 and device with watcher client application 104 of FIG. 1 are exemplified in FIG. 2 as doorbell 202 with additional functionality and handheld computing device 204, such as a smartphone, a PDA, and the like. In response to the doorbell being rung, a notification is sent by the doorbell 202 to other network 214 of connectivity and access layer 110. Connectivity and access layer 110 may include one or more networks. For example, a wired or wireless access network may be employed to establish communication with the doorbell and an IP network may be utilized to facilitate communication with computing device 204. The IP network may further be used to facilitate communications between the various applications of application layer 130. As mentioned previously, the networks of the connectivity and access layer may include secure, open, wired, wireless networks of any type including the Internet.

Control and session layer 120 manages communication sessions between the physical devices, client applications executed on the physical devices and the applications of the application layer 130. Moreover, control and session layer 120 may include resources such as data stores that enable operation of the applications of the application layer. While embodiments may be implemented with any type of control and session layer, an IMS example is provided in the following two figures.

Applications layer 130 includes doorbell application 232, presence server 234, and optional location service 236. As mentioned above, these applications may be executed on a single machine or on separate machines. Doorbell application 232 is configured to receive notification from doorbell 202, communicate with presence server 234 and optional location service 236 to determine a location and reach the user through computing device 204, and perform tasks for execution of action(s) selected by the user.

Presence server 234 is arranged to provide an indicator that the doorbell has been pressed and present various alternative actions to take to the user (e.g. resident). The actions may include initiating a VoIP conversation between the owner and the doorbell, requesting a digital image of the visitor, requesting a video image of the visitor, or ignoring the doorbell message. Optional location service 236 is arranged to determine a location of the user and provide it to doorbell application 232 such that communication with the user can be established. A number of other applications may also be configured, deployed, and shared in application layer 130.

According to some embodiments, one or more user interfaces ("UIs") may be provided in computing device 204 and doorbell 202 to enable the user and the person at the door to receive and provide information, such as action selections, alphanumeric entries, and the like. While a doorbell application has been described above as an example embodiment, other applications such as an alarm system with imaging functionality may also be implemented using the principles described herein. For example, a car alarm equipped with a camera may notify the owner if the car is being tempered with. Upon being notified by the monitoring system with integrated presence service, the owner may instruct the alarm to obtain one or more images, which are subsequently stored and/or forwarded to the owner.

Figure 3:
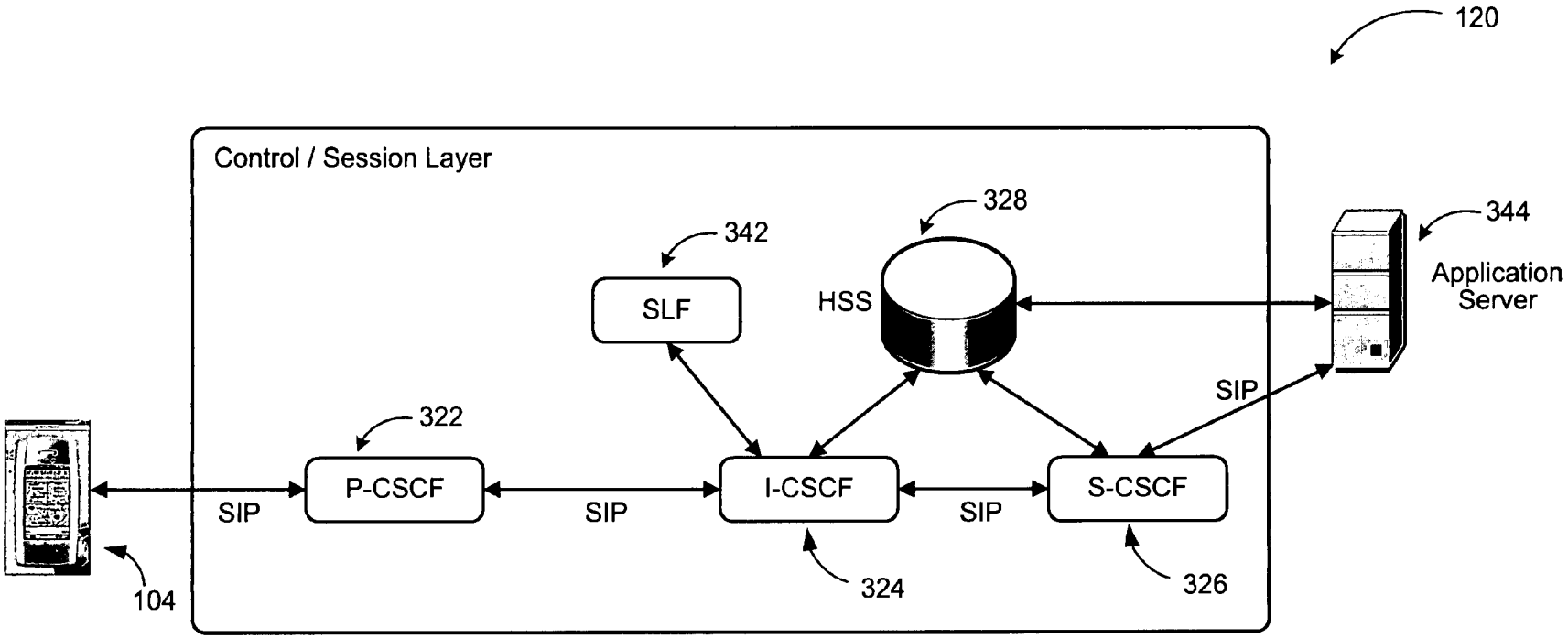
FIG. 3 illustrates main components of an IMS system architecture.

Now referring to FIG. 3, main components of an IMS system architecture are illustrated. IMS control and session layer includes a number of functions and a data store service. IMS is an open-systems architecture that supports a range of IP-based services over both packet switch and circuit switch networks, employing both wireless and fixed access technologies.

IMS provides services and control such as adding call session control to the packet network, enabling peer-to-peer real-time services such as voice or video over a packet-switched domain, and scalable common service control (based on SIP) for giving the ability to manage parallel user services. In a mixed multimedia environment, IMS may provide the ability to pick and mix various multimedia flows in single or multiple sessions and can handle real-time voice, video, and data. IMS also provides access to IP based services independent of the underlying access technology (mobile or fixed). IMS applications and drivers may include voice telephony (VoIP), video telephony, web browsing, presence-based services, push-to media services (e.g. push-to-talk, push-to-view, push-to-video, etc.), group chat, instant messaging, multimedia conferencing, content sharing/data transfer, and the like.

Still referring to FIG. 3, P-CSCF 322 is proxy call state control function, which is typically a first point of contact. It may provide privacy control, quality of service (QoS), authorization of local services, and similar functionalities. In the example architecture of FIG. 2, P-CSCF 322 may interact with computing device 104 using a Session Initiation Protocol (SIP). P-CSCF 322 interacts through SIP with I-CSCF 324 (interrogating call state control function), which may provide an access point functionality to the network and enable protection of a topology and configuration of the network. I-CSCF 324 interacts through SIP with S-CSCF 326 (serving call state control function), which provides session control services such as registration, accounting, and the like.

Both I-CSCF 324 and S-CSCF 326 interact with HSS 328 (home subscriber service), which is essentially a data store service for storing presence information (e.g. where the user can be reached). HSS 328 may be embodied as one or more data stores that may be managed by a data server. In addition, I-CSCF 324 may interact with SLF 342 (subscriber location function). SLF 342 may be an interface function for the optional location service 236 of architecture 200.

S-CSCF 326 also interacts with application server 344, which represents any server that includes applications of the application layer such as doorbell application 232 or presence service 234 of FIG. 2. An IMS architecture may include additional components such as a trunking signaling gateway, a media resource function controller, and the like. A basic configuration is illustrated here to describe interactions between a system according to embodiments and an IMS framework.

Figure 4:
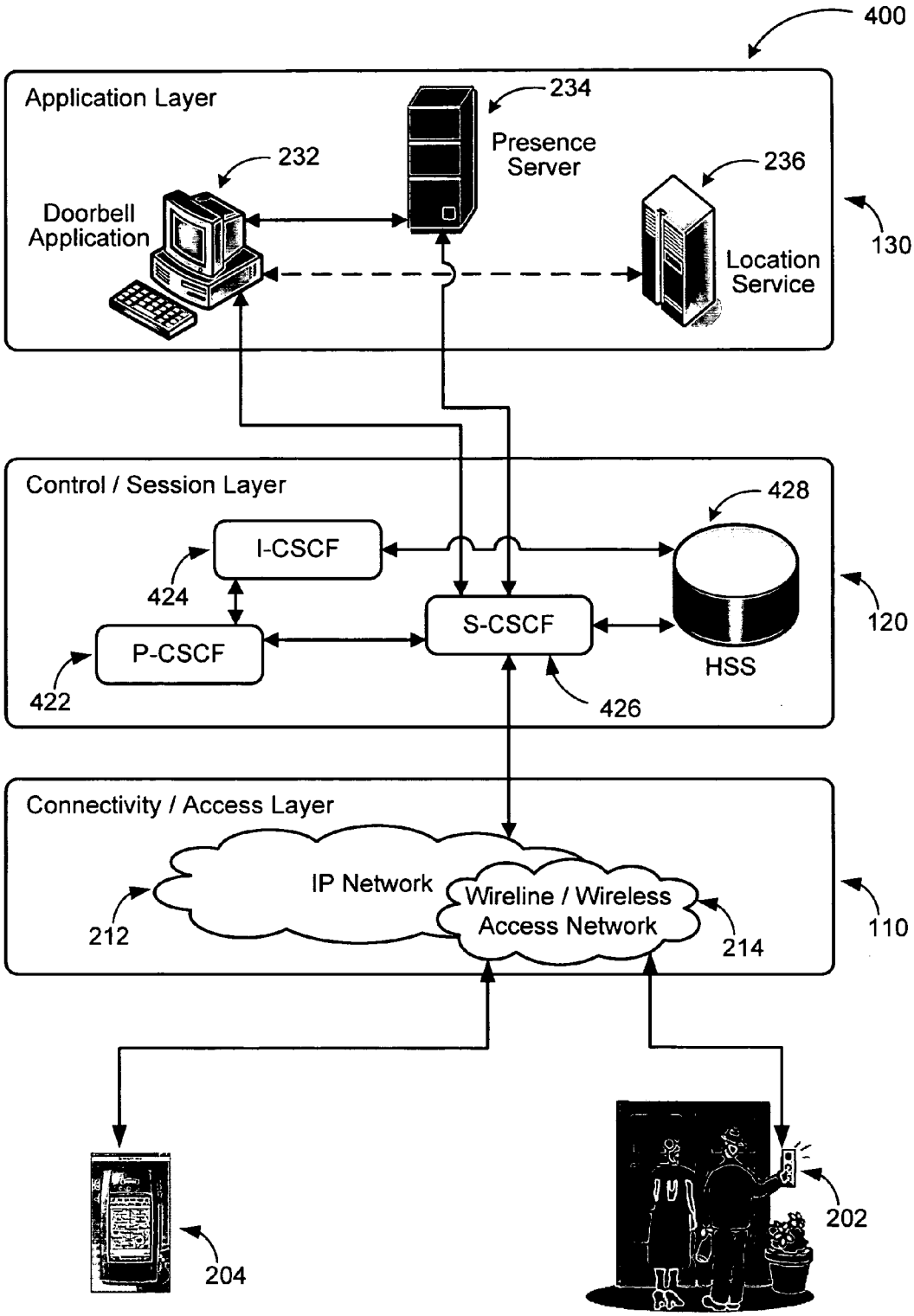
FIG. 4 illustrates the example doorbell presence service of FIG. 2 integrated with IMS architecture according to embodiments.

FIG. 4 illustrates the example doorbell presence service of FIG. 2 integrated with IMS architecture according to embodiments. The interactions in architecture 400 begin, as in architecture 200, with a button on doorbell 202 being pressed. The doorbell may be an IMS device with a profile in the IMS HSS component. The initial filter criteria in the IMS HSS may point to the doorbell presence service (doorbell application 232 and presence service 234). Notification is forwarded through wireline/wireless network 214 of connectivity and access layer 110 to IMS control and session layer 120. For the IMS session(s), the doorbell may register with P-CSCF 422 and I-CSCF 424. S-CSCF 426 may then initiate the IMS session based communications with doorbell application 232 and presence service 234. The communications may be facilitated through SIP messaging using IMS sessions. Doorbell application 232 determines a location of the user (resident) and notifies presence service 234, which may update presence information on HSS 428. Subsequently, the user is provided with the notification and a list of actions to be selected in response through a client application (watcher client application) on computing device 204.

The user may make selections including, but not limited to, initiating a VoIP conversation with the person at the door, initiating a video conference with the person at the door, obtain a still image or video of the person at the door, provide one of a plurality of "canned" messages to the person at the door, alert a monitoring service and the like. While performing these actions, the user may be in a remote location and access the system through another network such as the Internet.

Figure 5:
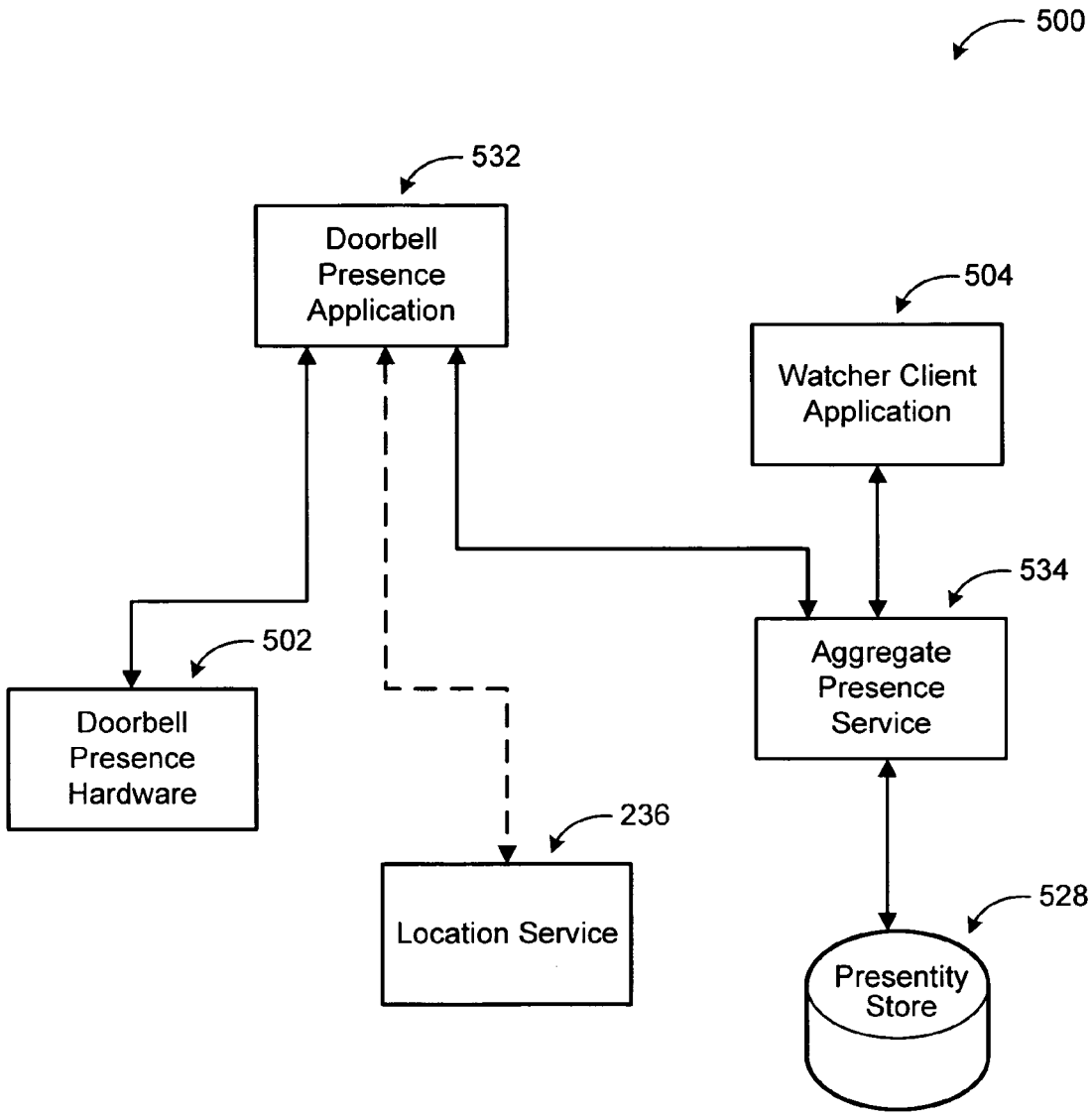
FIG. 5 illustrates a conceptual diagram of components of an example doorbell presence service.

FIG. 5 illustrates a conceptual diagram of components of an example doorbell presence service. The doorbell presence service is a network based service that receives messages from a residence whenever the doorbell is pressed. Diagram 500 summarizes the interactions described in FIG. 2 and FIG. 4. According to diagram 500, doorbell presence hardware 502 initiates a session by providing a notification to doorbell presence application 532 that someone is at the door. Doorbell presence application 532 may optionally determine a location of the resident using location service 236 and provide aggregate presence service 534 with the user's location and the notification. Aggregate presence service 534 updates a presentity store 528 and enables watcher client application 504 to provide the notification to the user. Watcher client application also provides a list of actions to be selected by the user. Once the user selects and action, aggregate presence service 534 facilitates the execution of tasks associated with the selected action in coordination with doorbell application 532 and any client applications that may be executed on the doorbell presence hardware 502 or computing devices in communication with the doorbell presence hardware 502.

The architecture and scenarios described in FIGS. 1 through 5 are for illustration purposes only and do not constitute a limitation on embodiments. Other configurations of a monitoring and entry system with presence service may be implemented without departing from a scope and spirit of the present invention.

Figure 6:
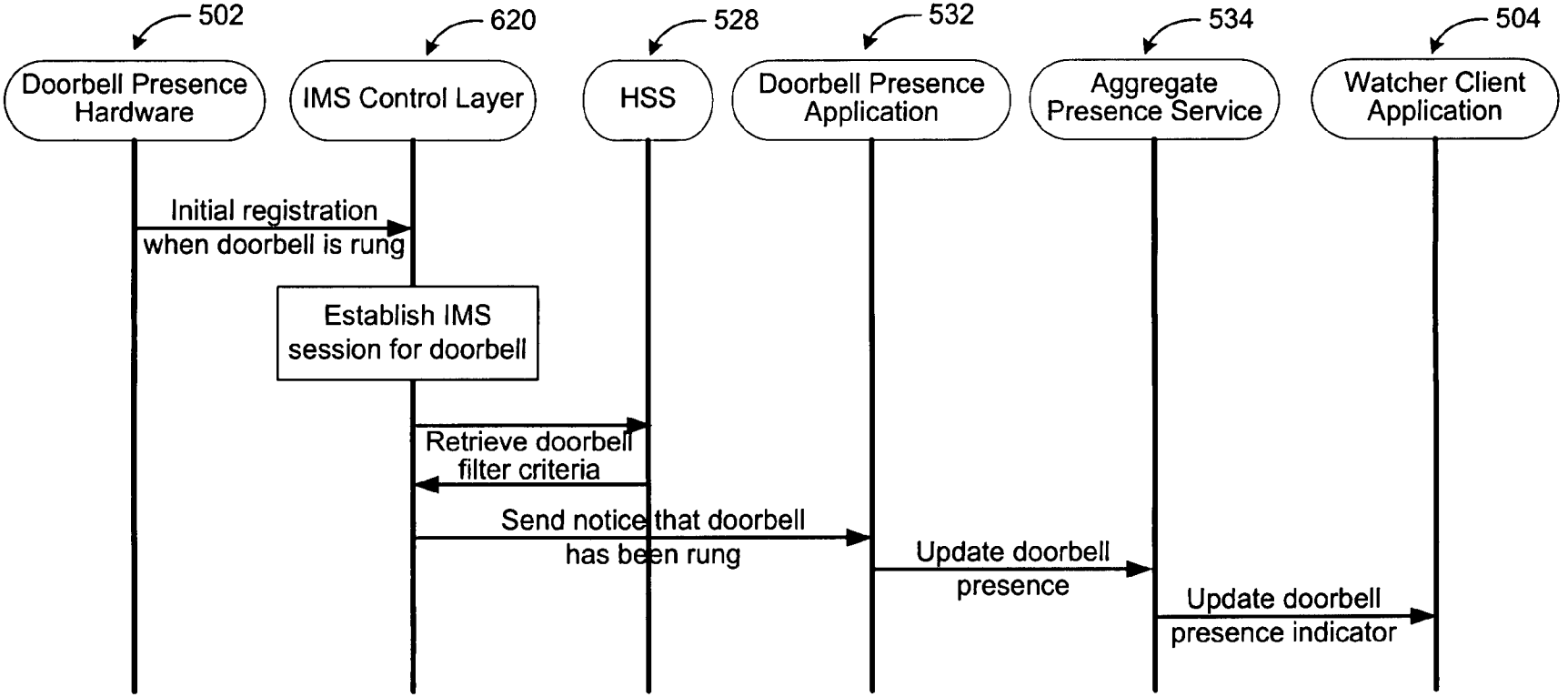
FIG. 6 illustrates action flows in the example doorbell presence service of FIG. 2.

FIG. 6 illustrates action flows in the example doorbell presence service of FIG. 2. The interactions are between components the doorbell presence service described above in detail.

The action flow begins with doorbell presence hardware 502 initiating a registration process with the IMS control layer 620 in response to the doorbell being rung. The IMS control layer establishes a session for the doorbell using SIP messaging and retrieves filter criteria for the doorbell from HSS 528, where a profile for the doorbell is stored.

The IMS control layer 620 then sends notice to doorbell presence application 532 that the doorbell has been rung. Although not shown, doorbell presence application 532 may determine a location of the resident using a location service. Doorbell presence application 532 then updates aggregate presence service 534 with the current location of the resident and the received notice. Aggregate presence service 534, in response, updates a doorbell presence indicator on watcher client application such as an icon, an LED indicator, and the like. Aggregate presence service may also update a presentity store with the information about the resident's current location.

Figure 7:
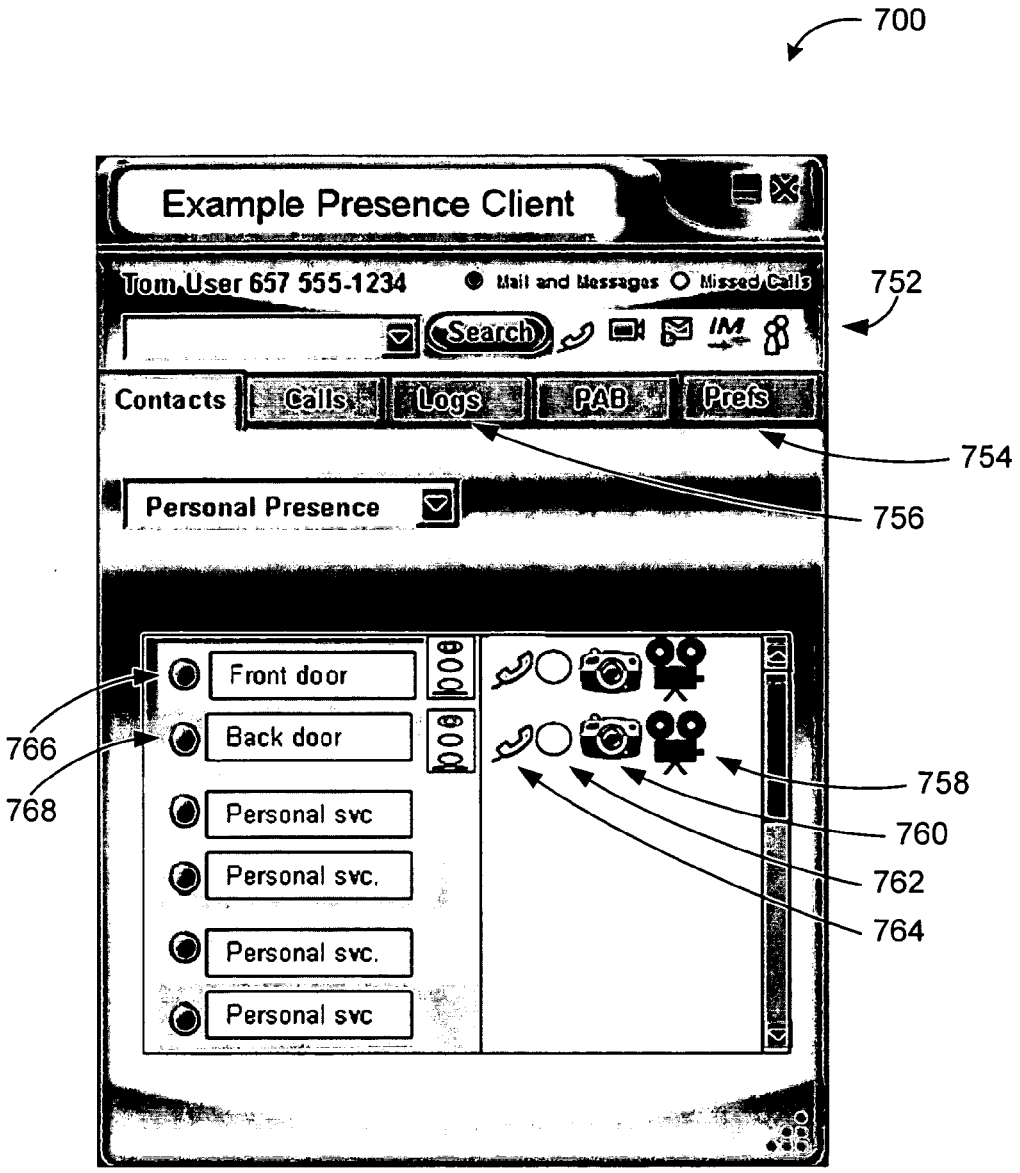
FIG. 7 illustrates an example doorbell presence application UI.

FIG. 7 illustrates an example doorbell presence application UI. UI 700 may be part of a watcher client application executed on a user device such as computing device 504. According to some embodiments, the user may be notified and presented with actions to select, as well as the actions executed using the same computing device. In other embodiments, any combinations of the above described events may be presented using separate computing devices.

UI 700 may include additional functionality such as phone service, instant message service, email service, and the like, as shown with icons 752. Different tabs may be provided for various aspects of the UI such as tab 754 (Preferences) for configuration changes, tab 756 (Logs) for recorded information. For a doorbell presence service, the UI may provide different indicators for different entry points such as front door 766 and back door 768. The notification that someone is at the door may be provided by changing a color of the indicator icon to the left of the location designator or the designator itself. Other methods such as flashing the designator, highlighting the designator, and the like, may also be used. Another icon to the right of the location designator indicates the presence of a doorbell presence hardware at the designated location.

Next, a number of icons (758, 760, 762, and 764) next to each location designator show available actions for that location. For example, both the back door 768 an front door 766 are equipped with doorbell presence hardware capable of establishing VoIP call (icon 764), taking picture (icon 760), and obtaining a video of the visitor (icon 758). A watcher client application and its associated UI(s) may of course include fewer or additional functions and present them in other configurations including, but not limited to, drop down menus, panes, separate view screens, and the like.

Figure 8:
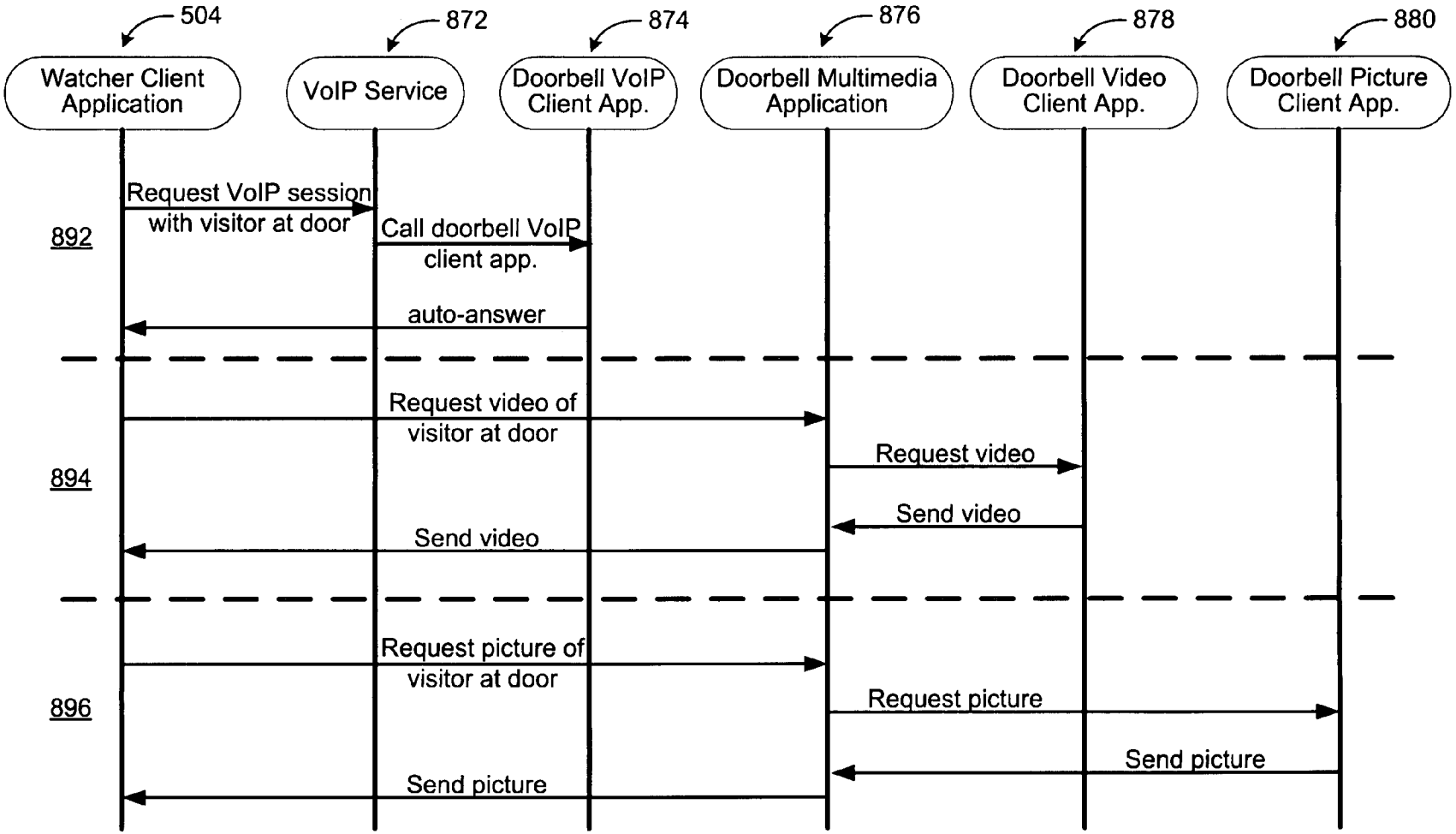
FIG. 8 illustrates action flows in the example doorbell presence service of FIG. 2 based on various watcher selection scenarios.

FIG. 8 illustrates action flows in the example doorbell presence service of FIG. 2 based on various watcher selection scenarios. The actions shown in FIG. 8 begin after the resident has received notification about the doorbell being rung and has been presented with a number of actions to select from. As mentioned previously, the actions may include a number of responses depending on capabilities of the system. Three example scenarios and action groups are provided here for illustration purposes.

According to first scenario 892, watcher client application 504 requests a VoIP session with the visitor at the door. The request is forwarded to VoIP service 872, which calls doorbell client VoIP application 874. Doorbell client VoIP application 874 may reside in doorbell presence hardware or may be executed in a computing device associated with the doorbell presence hardware. In response to the call, doorbell client VoIP application 874 may provide an auto-answer establishing VoIP call between the resident and the visitor at the door.

According to a second scenario 894, watcher client application 504 requests a video of the visitor at the door. The request is forwarded to doorbell multimedia application 876, which requests the video from doorbell video client application 878. Doorbell video client application 878 may also reside in doorbell presence hardware or may be executed in a computing device associated with the doorbell presence hardware. In response to the request, doorbell video client application 878 begins recording the video and providing it to doorbell multimedia application 876, which in turn forwards the video to watcher client application 504. In other embodiments, a video call may be established using the same or additional components.

According to a third scenario 896, watcher client application 504 requests a picture of the visitor at the door. The request is forwarded to doorbell multimedia application 876, which requests the picture from doorbell picture client application 880. Doorbell picture client application 880 may also reside in doorbell presence hardware or may be executed in a computing device associated with the doorbell presence hardware. In response to the request, doorbell picture client application 880 may take a still image of the visitor and provide it to doorbell multimedia application 876, which in turn forwards the picture to watcher client application 504. Two or more of the above described scenarios along with others may also be executed simultaneously.

The claimed subject matter also includes methods. These methods can be implemented in any number of ways, including the structures described in this document. One such way is by machine operations, of devices of the type described in this document.

Another optional way is for one or more of the individual operations of the methods to be performed in conjunction with one or more human operators performing some. These human operators need not be collocated with each other, but each can be only with a machine that performs a portion of the program.

Figure 9:
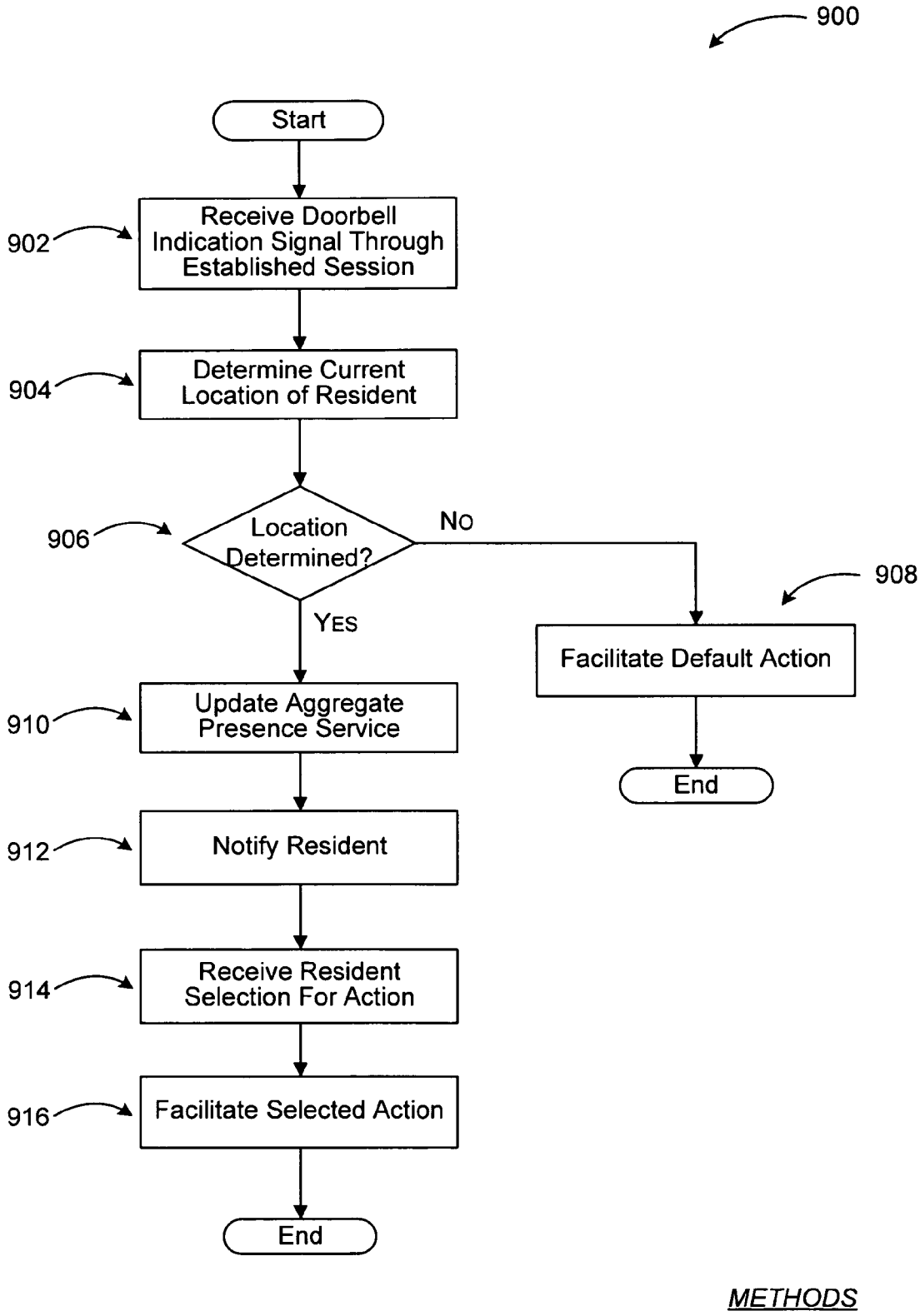
FIG. 9 illustrates a logic flow diagram for a process of providing doorbell presence service according to one embodiment.

FIG. 9 illustrates a logic flow diagram for a process of providing doorbell presence service according to one embodiment. Process 900 may be implemented in doorbell presence application 232.

Process 900 begins with operation 902, where doorbell application 232 receives an indication signal that someone is at the door through an established IMS session. The session may be established using SIP messaging over an IP network. Processing moves from operation 902 to operation 904.

At operation 904, the doorbell application 232 determines a current location of the resident using a location service. Processing moves from operation 904 to decision operation 906.

At decision operation 906, a determination is made whether the location is determined. If the location is not determined, the resident may not be reachable. In that case, processing moves to operation 908. Otherwise, processing advances from decision operation 906 to operation 910.

At operation 908, the doorbell application facilitates execution of a default action. A default action may include providing the person at the door a "canned" message, upon receiving a security code allowing entry, and the like. After operation 908, processing moves to a calling process for further actions.

At operation 910 following an affirmative determination at decision operation 906, the doorbell application 232 provides an aggregate presence service with the notification and the current location of the resident. The current location of the resident may also be used to determine a method and device to be used in contacting the resident. Processing advances from operation 910 to operation 912.

At operation 912, aggregate presence service 234 notifies the resident that there is someone at the door and provided a list of actions that may be taken in response to the notification. As mentioned before, the actions may include initiating a voice or video conversation, obtaining a still or video image, alerting a monitoring service, and the like. Processing moves from operation 912 to operation 914.

At operation 914, the aggregate presence service receives the user's selection among the presented actions through a client application. Processing advances from operation 914 to operation 916.

At operation 916, the aggregate presence service in coordination with doorbell application 232 facilitates the selected action. The action may require activation of another client application(s) that may reside in or interact with the doorbell presence hardware. After operation 916, processing moves to a calling process for further actions.

The operations included in process 900 are for illustration purposes. Providing doorbell presence service may be implemented by similar processes with fewer or additional steps, as well as in different order of operations using the principles described herein.

The above specification, examples and data provide a complete description of the manufacture and use of the composition of the embodiments. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims and embodiments.

What is claimed is:

1. A method for providing distributed access services between a watcher and at least one personal presentity, the method comprising:

receiving an alert from a personal presentity;

determining an availability of the watcher, wherein determining the availability of the watcher includes determining a current location of the watcher;

if the watcher is available, providing a notification associated with the alert to the watcher; and updating a presentity database based on the current location of the watcher.

2. The method of claim 1, further comprising:

providing the watcher a plurality of actions to select in response to the alert.

3. The method of claim 2, further comprising:

activating an application in response to a selection by the watcher, wherein the application includes at least one of: a voice communication through the personal presentity, a video communication through the personal presentity, an image acquisition application, and an electronic control application.

4. The method of claim 3, further comprising:

providing the notification and receiving the watcher selection through at least one Session Initiation Protocol (SIP) session using an IP Multi Media System (IMS) infrastructure.

5. The method of claim 3, wherein the voice communication is established employing a Voice over IP (VoIP) network.

6. The method of claim 1, wherein the personal presentity includes at least one of: a building entry system, a security monitoring system, and an equipment monitoring system.

7. The method of claim 1,further comprising:

if the watcher is not available, performing one of: providing a notification associated with the alert to another watcher and executing a predetermined response action.

8. A computer-readable storage medium having computer executable instructions for providing a monitoring and entry system presence service, the instructions comprising:

in response to a trigger event, receiving an indication signal from an interface device;

determining a current location of a user;

updating a presence data store with the current location of the user;

providing the user a notification associated with the trigger event and a plurality of actions to select in response to the notification;

in response to a selection by the user activating an application associated with the monitoring and entry system presence service.

9. A computer-readable storage medium of claim 8, wherein the instructions further comprise:

selecting a client application and a client device to provide the notification and to present the plurality of actions to the user based on the current location of the user.

10. A computer-readable storage medium of claim 9, wherein the user is a watcher and the client device is a personal presentity.

11. A computer-readable storage medium of claim 10, wherein the application includes at least one of: a voice communication through the personal presentity, a video communication through the personal presentity, an image acquisition application, and an electronic control application.

12. A system for providing distributed access services between a watcher and a personal presentity, comprising:

an interface device configured to:

detect a trigger event; and provide a notification associated with the trigger event through an IMS infrastructure network, wherein the interface device acts as the personal presentity; and a presentity application configured to:

receive the notification;

determine a current location of the watcher;

provide the current location of the watcher and the notification to an aggregate presence service such that the aggregate presence service can provide the notification and a plurality of actions to the watcher through a watcher client application, and receive a watcher selection from the watcher client application; and in response to receiving the watcher selection from the aggregate presence service, facilitate execution of the action by activating one of a plurality of client applications associated with the personal presentity.

13. The system of claim 12, wherein the presentity application is a doorbell presence application and the personal presentity is a doorbell presence hardware.

14. The system of claim 13, wherein doorbell presence application is further configured to:

manage at least one from a set of: a VoIP call between the watcher and a person using the doorbell presence hardware, a capture of a still image of the person, a capture of a video of the person, and a control mechanism activation by activating one of the plurality of client applications associated with the doorbell presence hardware.

15. The system of claim 13, wherein the doorbell presence application is configured to communicate with the aggregate presence service and the plurality of client applications through one or more SIP sessions using the IMS infrastructure.

16. The system of claim 13, wherein the doorbell presence application is further configured to register and update a profile associated with the doorbell presence hardware in a home subscriber service component of the IMS infrastructure.

17. The system of claim 12, wherein the personal presentity is a monitoring device configured to capture an image of a monitored location in response to a selection by the watcher, and wherein the presentity application is a monitoring presence application configured to manage notification of the watcher and delivery of the captured image to the watcher.

18. A method for providing distributed access services between a watcher and at least one personal presentity, the method comprising:

receiving an alert from a personal presentity;

determining an availability of the watcher, wherein determining the availability of the watcher includes determining a current location of the watcher;

if the watcher is available, providing a notification associated with the alert to the watcher; and selecting an interface device and an associated watcher client application to provide the watcher the notification and to present a plurality of actions based on the location of the watcher.

* * * * *